US006800991B2

(12) United States Patent
Choi

(10) Patent No.: US 6,800,991 B2
(45) Date of Patent: Oct. 5, 2004

(54) CATHODE RAY TUBE

(75) Inventor: Jin Yeal Choi, Gumi-si (KR)

(73) Assignee: LG. Philips Displays Korea Co., Ltd., Gyeongsangbuk-do (KR)

( * ) Notice: Subject to any disclaimer, the term of this patent is extended or adjusted under 35 U.S.C. 154(b) by 71 days.

(21) Appl. No.: 10/359,627

(22) Filed: Feb. 7, 2003

(65) Prior Publication Data

US 2003/0146685 A1 Aug. 7, 2003

(30) Foreign Application Priority Data

Feb. 7, 2002 (KR) ..... 10-2002-0007071
Jul. 25, 2002 (KR) ..... 10-2002-0043768

(51) Int. Cl.[7] ..... H01J 29/50; H01J 29/70; H01J 29/46

(52) U.S. Cl. ..... 313/414; 313/412; 313/413; 313/426; 313/427; 313/428; 313/417

(58) Field of Search ..... 313/412–414, 313/418, 426–428

(56) References Cited

U.S. PATENT DOCUMENTS 5,814,930 A * 9/1998 Watanabe et al. ..... 313/414
6,288,482 B1 9/2001 Watanabe et al.
6,664,725 B2 * 12/2003 Shiroishi et al. ..... 313/414

FOREIGN PATENT DOCUMENTS

JP 8-203446 A 8/1996
JP 10-12155 A 1/1998

* cited by examiner

*Primary Examiner*—Nimeshkumar D. Patel
*Assistant Examiner*—Matt Hodges
(74) *Attorney, Agent, or Firm*—Birch, Stewart, Kolasch & Birch, LLP

(57) ABSTRACT

Disclosed is a cathode ray tube with an electron gun capable of improving a resolution of an image by preventing electron beams from striking electrodes and efficiently controlling a spot size that is susceptible to a change in current capacity.

12 Claims, 17 Drawing Sheets

(a)

(b)

(a)

(b)

(a)

(b)

CATHODE RAY TUBE

BACKGROUND OF THE INVENTION

1. Field of the Invention

The present invention relates to a cathode ray tube, and more particularly, to a cathode ray tube having an electron gun capable of improving a resolution of an image by preventing electron beams from striking electrodes and efficiently controlling a spot size that is susceptible to a change in current capacity.

2. Background of the Related Art

FIG. 1 is an explanatory view of a general cathode ray tube in a related art.

As depicted in FIG. 1, the cathode ray tube consists of a panel 1 with a fluorescent screen 13 formed on its inner surface, in which R, G, and B fluorescent substances (or phosphors) are applied to the screen, a funnel 12 fused to a rear end of the panel 10 for maintaining the inside of the tube in a vacuum state, an electron gun housed inside of a neck portion 15 of the funnel 12 for emitting electron beams, a deflection yoke 11 for deflecting the electron beams emitted from the electron gun 16, and a shadow mask 14 with a color selecting function for the electron beams that are deflected by the deflection yoke 11.

Normally in this kind of cathode ray tube, the electron beams emitted from the electron gun 16 are deflected by the deflection yoke 11 in the horizontal and vertical directions, and then pass through the shadow mask 14, and eventually strike the fluorescent screen 13.

When that happens, each fluorescent substance (i.e. R, G and B) applied to the fluorescent screen 13 is radiated or emits light, thereby creating a desired image.

FIG. 2 diagrammatically illustrates the structure of an electron gun according to a related art.

Referring to FIG. 2, the electron gun consists of a cathode 20 working as an electron beam generator, a first electrode (G1) 21 and a second electrode (G2) 22 whose potential difference constitutes, in combination with the cathode 20, a pre-focus lens, a third electrode (G3) 23 and a fourth electrode (G4) 24 and a fifth electrode (G5) 25 that constitute a pre-main lens for converging electron beams, and a fifth electrode 25 and a sixth electrode (G6) 26 that constitute, in combination with the pre-main lens, a main lens for converging the electron beams onto the fluorescent screen.

Besides the above, there is one more main component of the electron gun, i.e. a shield cup 27, which is fused to the sixth electrode 26 in order to shun off the outside electric field and magnetic field. The electrodes are then fused and fixed to a bead glass 28.

Particularly, the fourth electrode 24, as illustrated in FIG. 3, is a plate electrode having a predetermined thickness, t. Also, formed on the fourth electrode are three circular electron beam passing holes 24*b* which are spaced out by a predetermined distance from each other for passing through R, G and B electron beams.

Further, projection type bead supports 24*a* are disposed at the top and bottom sides of the fourth electrode 24. Mainly, the bead supports 24*a* are used to make sure that the electrodes are securely fused and fixed to the bead glass 28.

FIG. 4(*a*) is a plan view of the second electrode 22 for the conventional electron gun, explaining the structure of the second electrode 22, and FIG. 4(*b*) is an enlarged cross-sectional view of a part "22*e*" in FIG. 4(*a*).

As depicted in the drawing, the second electrode 22 basically looks similar to the above-discussed fourth electrode 24. That is, the second electrode 22 is a plate electrode like the fourth electrode 24, and it has three circular electron beam passing holes 22*b* disposed at regular intervals for passing through R, G and B electron beams, and bead supports 22*a* for ensuring electrodes to be securely fused and fixed to the bead glass 28.

As for the second electrode 22, however, each electron beam passing hole 22*b* is surrounded by an outer concentric circle, namely, a coining part 22*b*, which serves to minimize manufacturing difficulties and deformation, and formed inside the coining part 22*d* is a rectangular shaped recess 22*c* with a constant, unified depth in the horizontal direction at an opening part of the second electrode 22 towards the third electrode 23.

More specifically, the recess 22*c* forms a groove having a constant depth, and the electron beam passing hole 22*b* is located at the center of the groove. In fact, one can more easily fabricate the electron beam passing hole 22*b* by having the electron beam passing hole 22*b* be formed in the recess 22*c* with a relatively thinner thickness than the total thickness of the second electrode 22.

Now turning to the operation of the electron gun with the above structure, first of all, an electron beam is formed by the first electrode 21 and the second electrode 22, and the electron beam is primarily converged by the pre-focus lens formed by the potential difference between the second electrode 22 and the third electrode 23, and then largely converged by the pre-main lens formed by the potential difference among the third electrode 23, the fourth electrode 24, and the fifth electrode 25.

The electron beam having been primarily converged by the pre-main lens passes the main lens formed by the potential difference between the fifth electrode 25 and the sixth electrode 26, and is again converged and accelerated, thereby forming an electron beam spot on the fluorescent screen.

The third electrode 23 and the fifth electrode 25 have the unified potential, which is, in general, between 6000V and 10000V.

In addition, the second electrode 22 and the fourth electrode 24 have the unified potential, which is, in general, between 300V and 1000V.

Each in-line type electron beam in opposition to the R, G and B fluorescent substances applied to the fluorescent screen 13 is converged to one single point so as to reproduce a desired color.

In other words, those three electron beams are respectively converged by the main lens, and combined to a focal point on the fluorescent screen 13, forming an electron beam spot on the screen.

In connection with convergence of the spot on the screen, Japanese Patent Publication No. 53-18866 discloses a method for preventing deterioration in the convergence of spots on the screen by forming a recess 22*c* in the horizontal direction at the opening part of the second electrode 22 toward the third electrode side 23.

FIG. 5 diagrammatically depicts the shape of an electron beam incidented upon the main lens and the shapes of electron beams exhibited on the fluorescent screen.

Referring to FIG. 5, the electron beam incidented upon the main lens is horizontally oblong, that is, the width (a) is longer than the length (b). It is so because the depth toward the direction of the electrode thickness of the recess 22*c* is large. In result, the electron beam is very astigmatic, and deflection aberration observed on the entire screen can be well compensated.

As such, the ratio of the length to the width, b/a, and size of the electron beam incidented on the main lens contributes to the spot size throughout the screen and further resolution of a cathode ray tube. As shown in FIG. 6, the ratio of the length to the width, b/a, of the electron beam incidented on the main lens is closely connected to the depth, d, of the recess formed on the second electrode 22 and the vertical width (size), W, of the recess.

There have been numbers of attempts to reduce the deflection aberration of electron beams and deterioration of beam spot in the vicinity of the screen by, for example, forming the recess 22*c* on the second electrode 22 and making the ratio of the depth, d, to the width, W, of the recess 22*c* (d/W) greater than 0.3 so as to generate severely astigmatic beams, and then adjusting the ratio of d to W of the electron beam incidented on the main lens.

However, the above attempts only gave rise to a problem that the spot size at the center of the screen was vertically elongated due to the astigmatism.

In another aspect, as more and more people are now watching moving images on a computer monitor thanks to a great achievement in Internet development, an electron gun with high brightness for computer monitors was introduced because the monitor cathode ray tube failed to provide substantially realistic and bright pictures as TV cathode ray tube did.

But this kind of electron gun consumed more than three times greater current than the conventional electron gun. The worse part was that the spots throughout the screen got bigger when current consumption was increased, and the resolution was also degraded due to the big spots.

In short, despite the formation of the recess on the second electrode for controlling electron beams, the resolution of the screen was still low in case more current was applied to the electron gun.

Moreover, increase in the current capacity increased the diameter of electron beams as shown FIG. 7 (D'>D), and this caused the electron beams to strike electrodes, consequently destroying a circuit therein.

SUMMARY OF THE INVENTION

An object of the invention is to solve at least the above problems and/or disadvantages and to provide at least the advantages described hereinafter.

Accordingly, one object of the present invention is to solve the foregoing problems by providing a cathode ray tube equipped with an electron gun capable of improving a resolution of an image by preventing electron beams from striking electrodes and efficiently controlling a spot size that is susceptible to a change in current capacity.

The foregoing object and advantages are realized by providing a cathode ray tube equipped with an electron gun consisting of a cathode for emitting electron beams; and a first electrode, a second electrode, a third electrode, a fourth electrode, a fifth electrode, a sixth electrode and a shield cup, which are arranged in the cited order from the cathode to the direction of a (fluorescent) screen, where a vertical size, W, of a recess formed on the second electrode, a depth, d, of the recess, a diameter, A, of an electron beam passing hole formed on the fourth electrode, and a thickness, t, of the electron beam passing hole satisfy a relation of $$0.22 \le \frac{d}{W} + \frac{t}{A} \le 0.38.$$

Another aspect of the invention provides a cathode ray tube equipped with an electron gun consisting of a cathode for emitting electron beams; and a first electrode, a second electrode, a third electrode, a fourth electrode, a fifth electrode, a sixth electrode and a shield cup, which are arranged in the cited order from the cathode to the direction of a (fluorescent) screen, coining parts being formed on a front surface of the second electrode at regular intervals, where a thickness, h, of the electrodes without adding a depth of the coining part, a space, s, between the second electrode and the third electrode, a thickness, t, of the fourth electrode, which is spaced out for a predetermined distance from the third electrode, and a diameter, A, of an electron beam passing hole formed on the fourth electrode satisfy a relation of $$0.6 \le \frac{h}{s} + \frac{t}{A} \le 0.8.$$

Still another aspect of the invention provides a cathode ray tube equipped with an electron gun consisting of a cathode for emitting electron beams; and a first electrode, a second electrode, a third electrode, a fourth electrode, a fifth electrode, a sixth electrode and a shield cup, which are arranged in the cited order from the cathode to the direction of a (fluorescent) screen, coining parts and recesses being formed on a front surface of the second electrode at regular intervals, where a thickness, h, of the electrodes without adding a depth of the coining part, a vertical size, W, of the recess, a depth, d, of the recess, a space, s, between the second electrode and the third electrode, a thickness, t, of the fourth electrode, which is spaced out for a predetermined distance from the third electrode, and a diameter, A, of an electron beam passing hole formed on the fourth electrode satisfy relations of $$0.22 \le \frac{d}{W} + \frac{t}{A} \le 0.38 \text{ and } 0.6 \le \frac{h}{s} + \frac{t}{A} \le 0.8.$$

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

and

Figure 17:
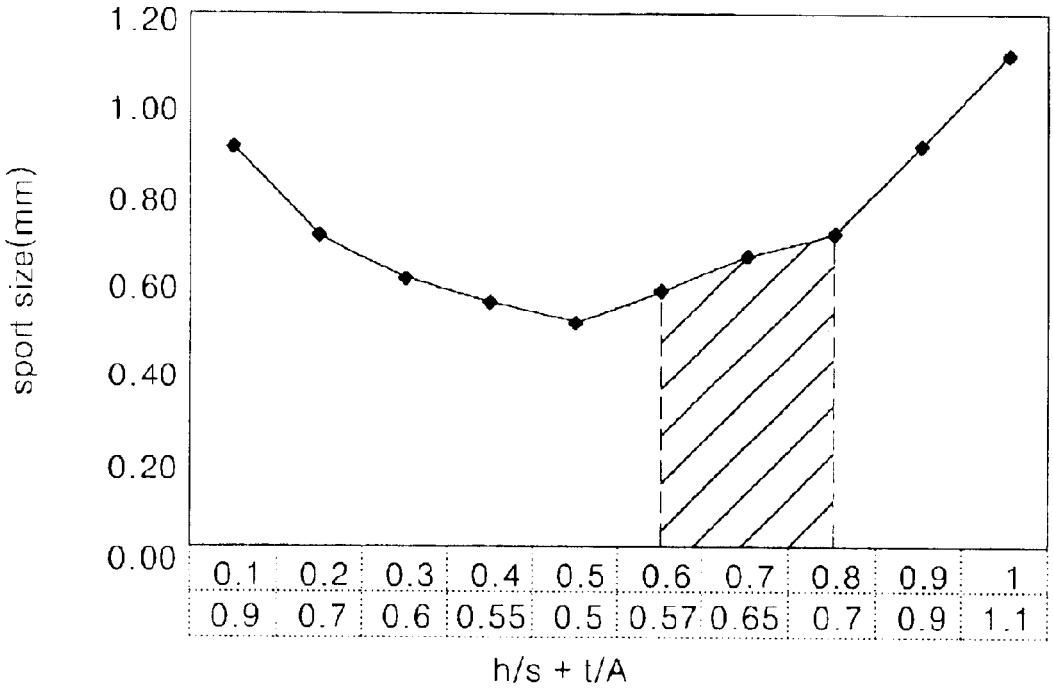

FIG. 17 graphically depicts a relation between the spot size and the value of $$\frac{h}{s}+\frac{t}{A}.$$

DETAILED DESCRIPTION OF PREFERRED EMBODIMENTS

The following detailed description will present a cathode ray tube according to a preferred embodiment of the invention in reference to the accompanying drawings.

Figure 8:
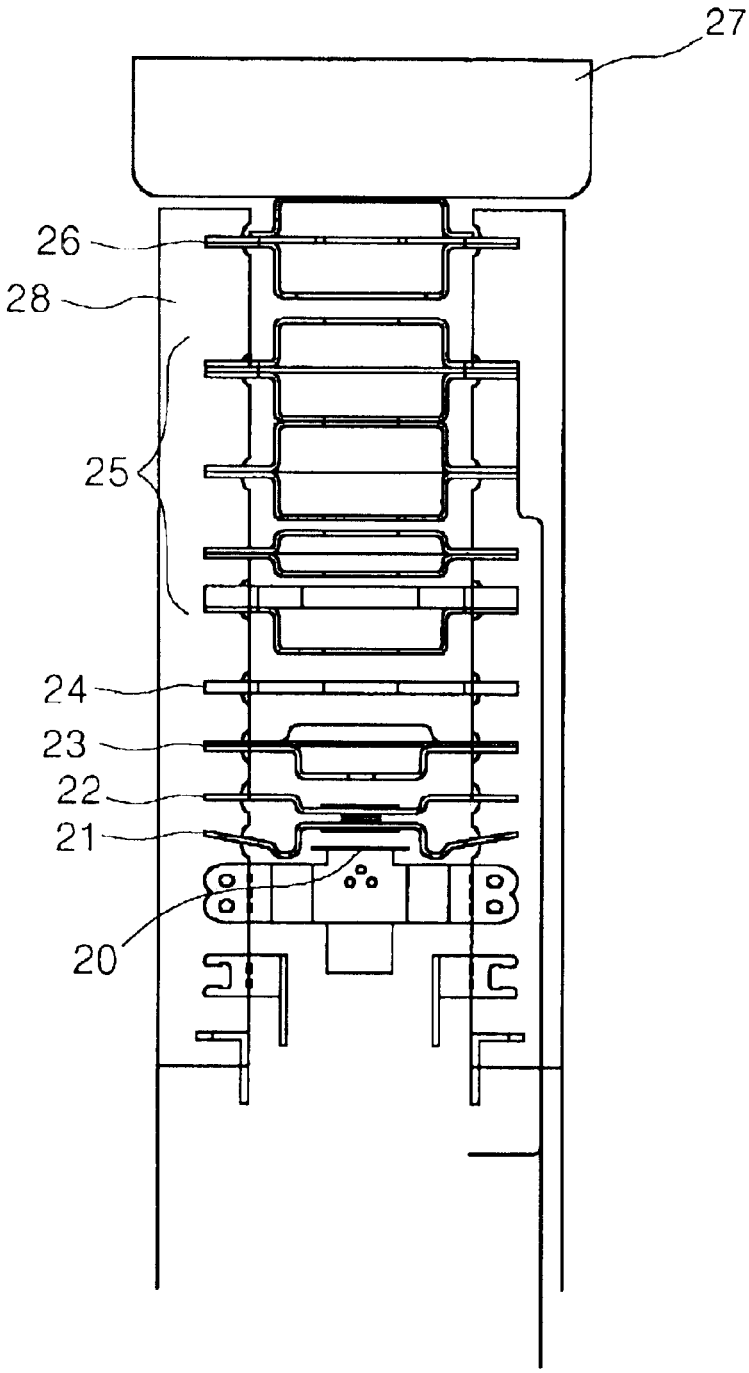
FIG. 8 diagrammatically explains an electron gun for a cathode ray tube according to the present invention.

FIG. 8 is a diagram explaining an electron gun for the cathode ray tube according to the present invention.

Referring to FIG. 8, the electron gun consists of a cathode 20 working as an electron beam generator, a first electrode 21 and a second electrode 22 whose potential difference constitutes, in combination with the cathode 20, a pre-focus lens, a third electrode 23 and a fourth electrode 24 and a fifth electrode 25 that constitute a pre-main lens for converging electron beams, and a fifth electrode 25 and a sixth electrode 26 that constitute, in combination with the pre-main lens, a main lens for converging the electron beams onto a fluorescent screen.

Besides the above, there is one more main component of the electron gun, i.e. a shield cup 27, which is fused to the sixth electrode 26 in order to shun off the outside electric field and magnetic field. The electrodes are then fused and fixed to a bead glass 28

The third electrode 23 and the fifth electrode 25 have the unified potential, which is, in general, between 6000V and 10000V.

In addition, the second electrode 22 and the fourth electrode 24 have the unified potential, which is, in general, between 300V and 1000V.

Figure 9:
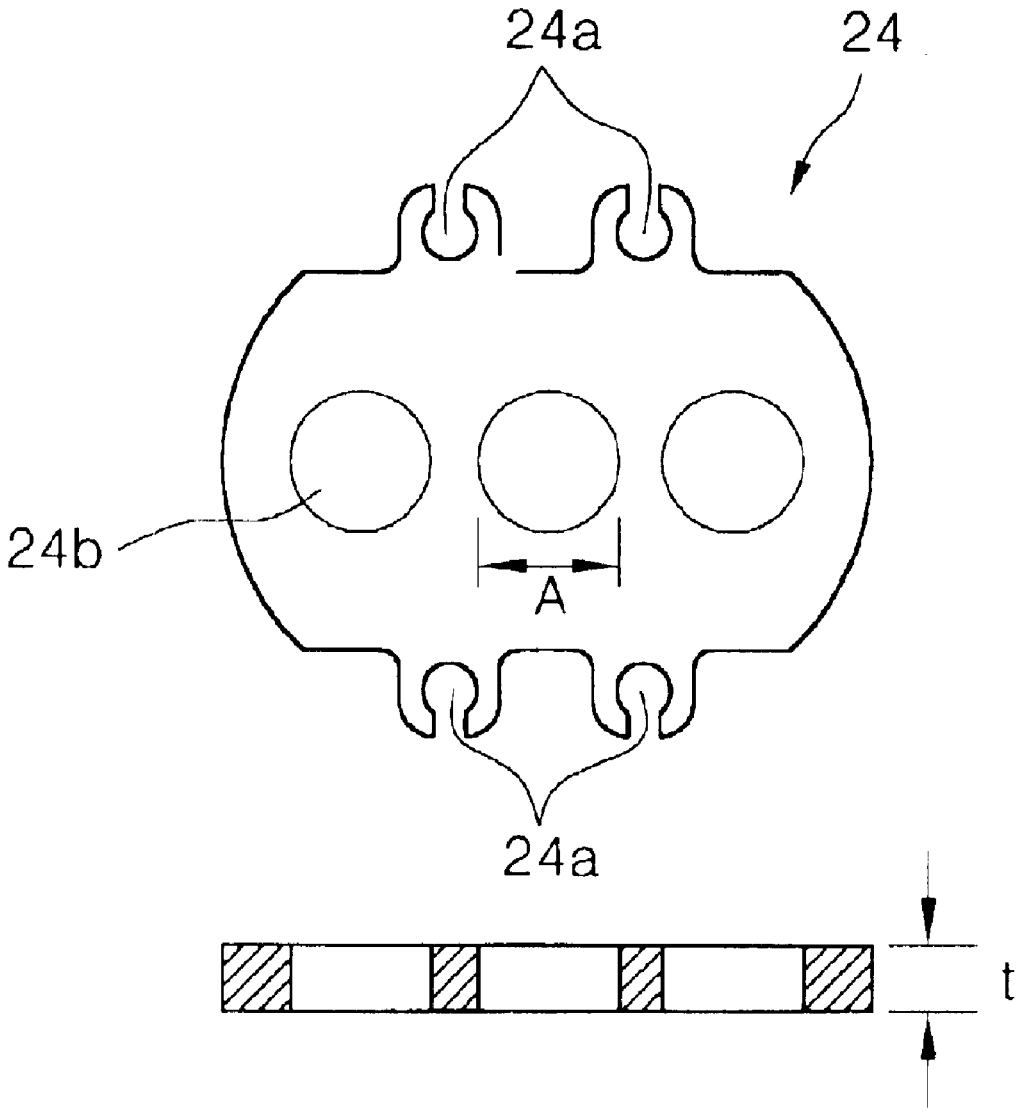
FIG. 9 is an explanatory diagram of an electron beam passing hole formed on a fourth electrode of the cathode ray tube according to the present invention.

FIG. 9 diagrammatically explains an electron beam passing hole formed on the fourth electrode.

The fourth electrode 24, as illustrated in FIG. 9, is a plate electrode having a predetermined thickness, t. Also, formed on the fourth electrode are three circular electron beam passing holes 24*b* with a predetermined diameter, A, which are spaced out by a predetermined distance from each other for passing through R, G and B electron beams.

Further, projection type bead supports 24*a* are disposed at the top and bottom sides of the fourth electrode 24. Primarily, the bead supports 24*a* serve to make sure that the electrodes are securely fused and fixed to the bead glass 28.

As a matter of fact, a vertical size and horizontal size of the electron beam incidented upon the main lens are in a close relation with the diameter, A, and thickness, t, of the electron beam passing hole formed on the fourth electrode 24.

Figure 10:
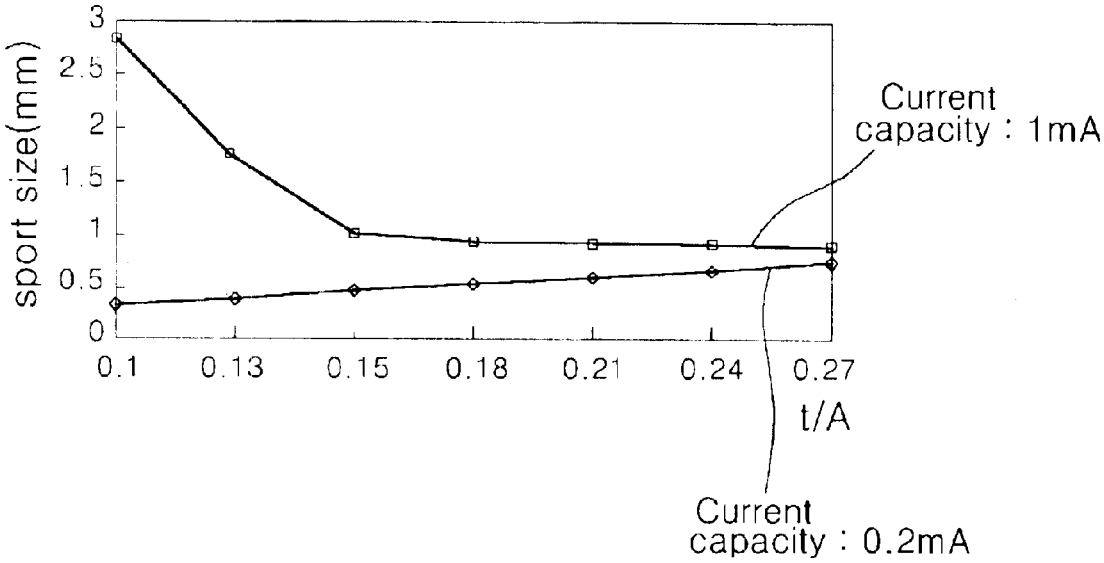
FIG. 10 graphically depicts a relation between the diameter, A, and thickness, t, of the electron beam passing hole formed on the fourth electrode and a spot size.

FIG. 10 is a graph illustrating the relation between the spot size and the diameter, A, and thickness, t, of the electron beam passing hole formed on the fourth electrode.

For instance, suppose that a high current (e.g. 1 mA) is applied to the electron gun. In such case, the spot size gets smaller as the value of t/A increases. On the other hand, suppose that a low current (e.g. 0.2 mA) is applied to the electron gun. Then, the spot size gets bigger as the value of t/A increases.

Figure 11:
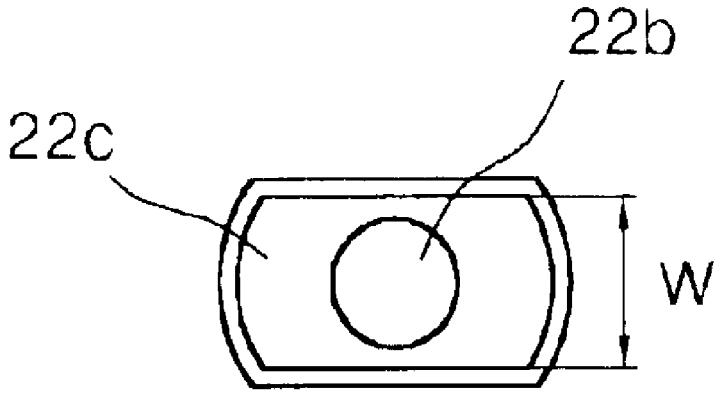
FIG. 11 is an enlarged view of the structure of a second electrode.
Figure 11:
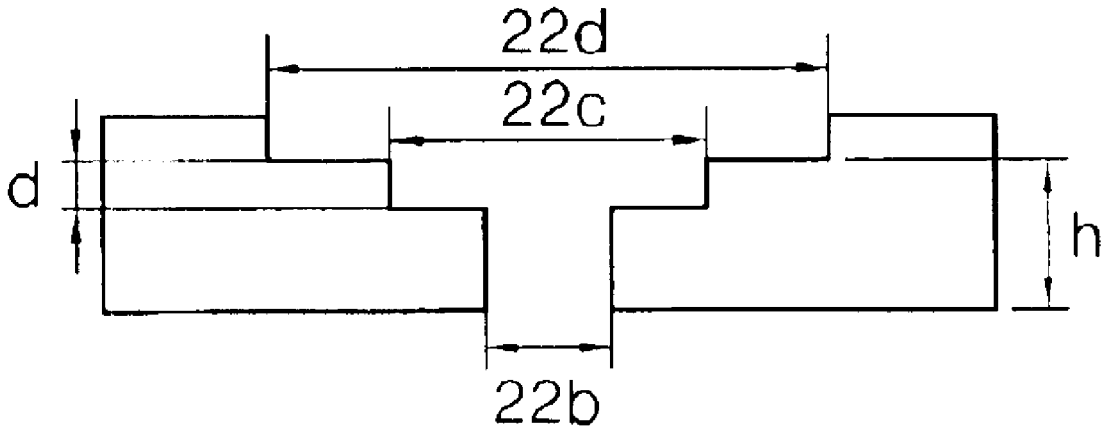

FIG. 11 is an enlarged view explaining the structure of the second electrode.

Figure 1:
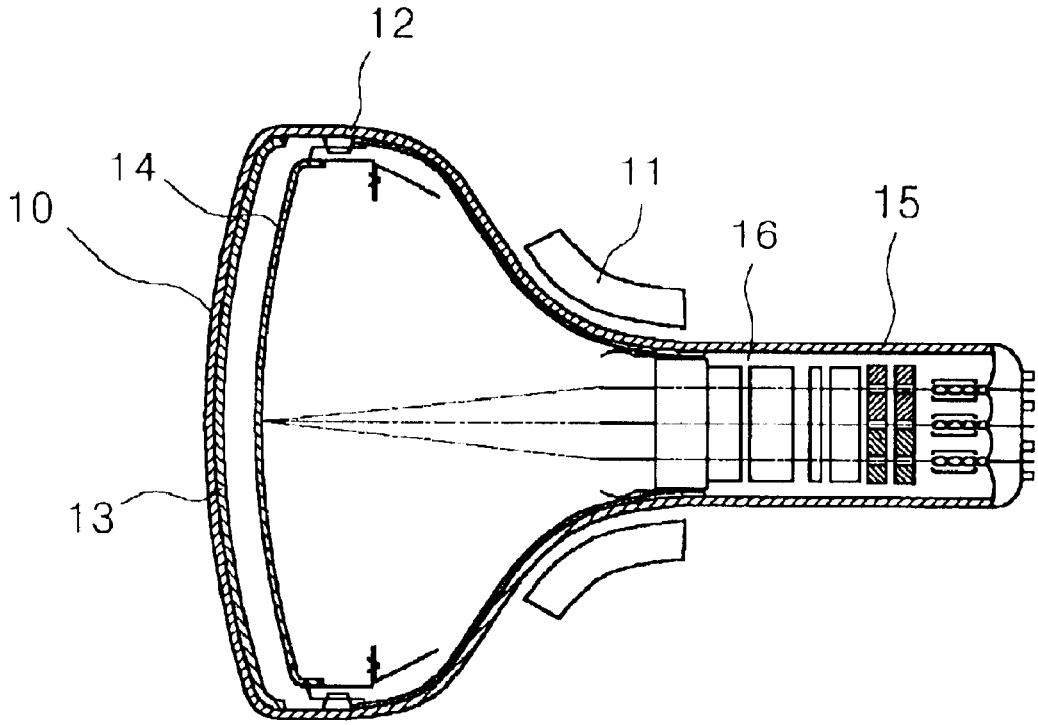
FIG. 1 (Related Art)
FIG. 1 is an explanatory diagram of the structure of a generally known cathode ray tube according to a related art.
Figure 2:
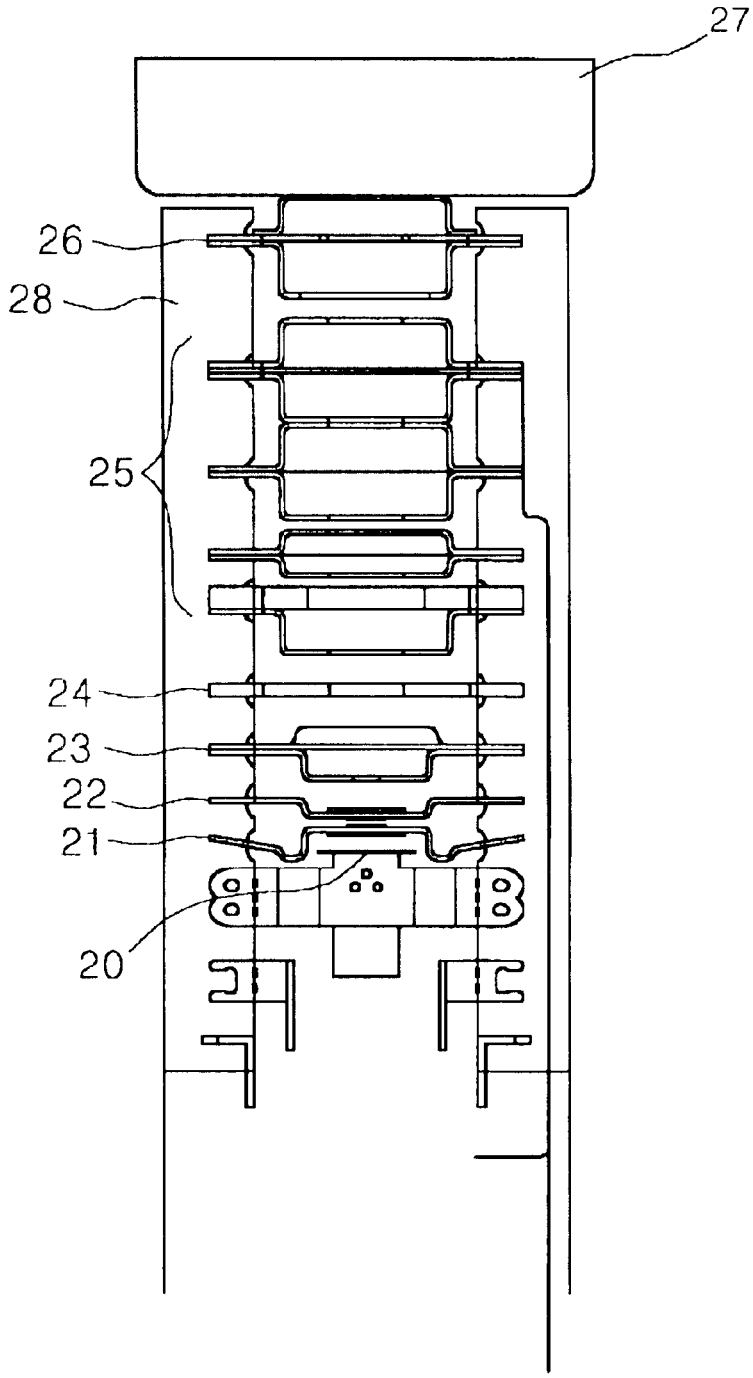
FIG. 2 (Related Art)
FIG. 2 diagrammatically explains the structure of a generally known electron gun.
Figure 3:
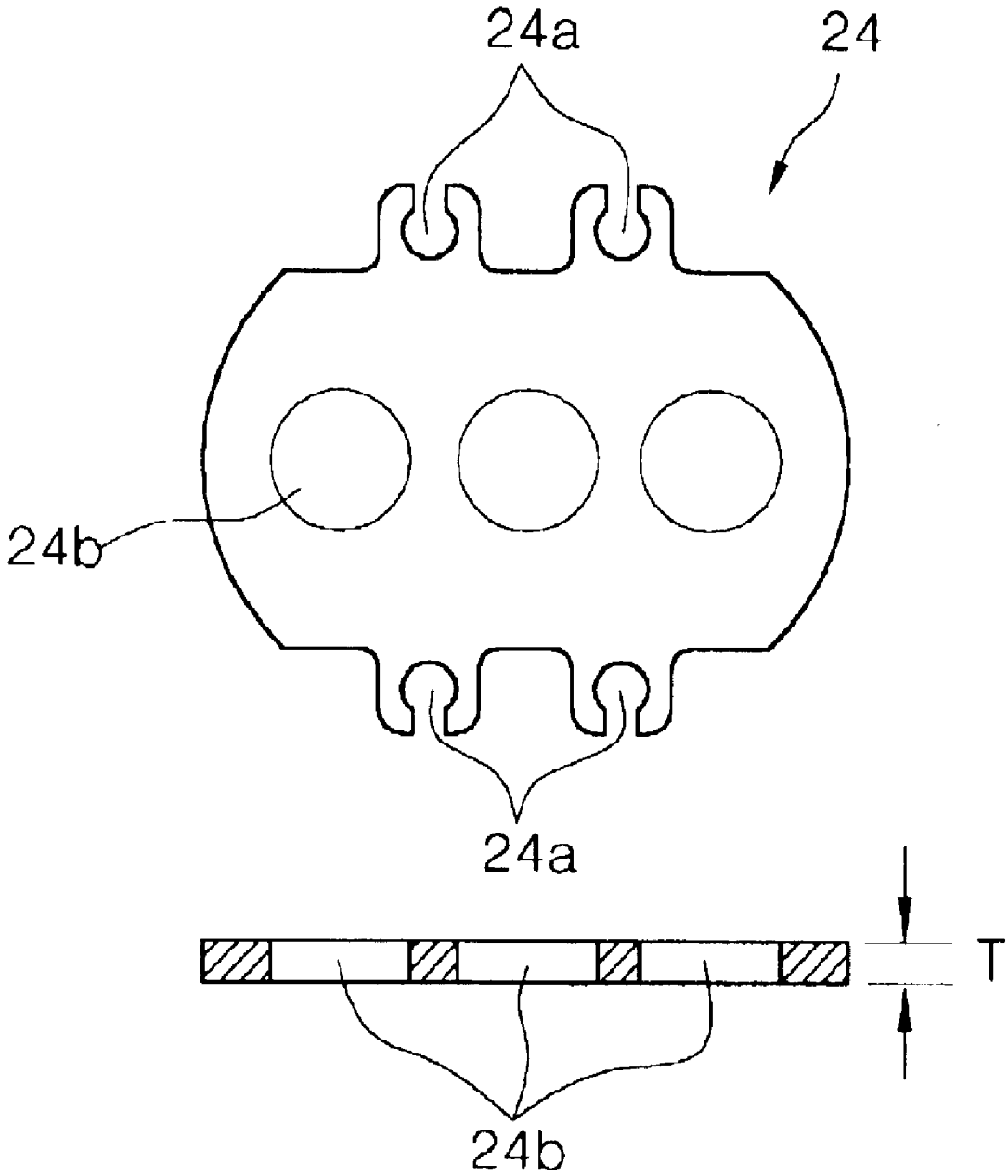
FIG. 3 (Related Art)
FIG. 3 is an explanatory diagram of the structure of a fourth electrode.
Figure 4:
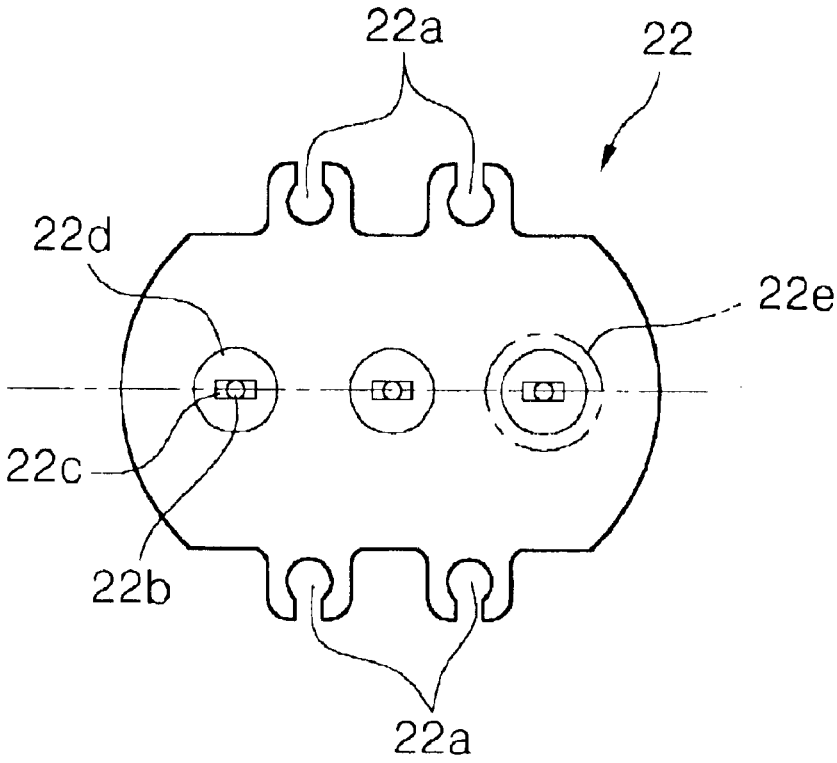
FIG. 4 (Related Art)
FIG. 4(*a*) is a plan view of a second electrode housed in the conventional electron gun, explaining the structure of the second electrode, and FIG. 4(*b*) is an enlarged cross-sectional view of a "A" part of the second electrode.
Figure 4:
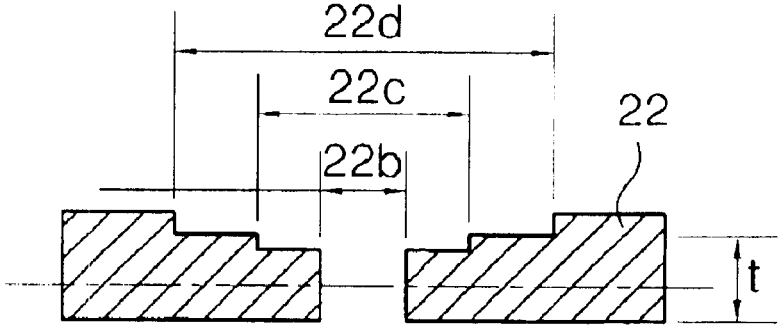
FIG. 4 (Related Art)

As already discussed with reference to FIG. 4, the second electrode 22 is a plate electrode, and there are formed circular shaped coining parts (see 22*d* in FIG. 4) that serve to minimize manufacturing difficulties and deformation of the electron beam passing hole 22*b*, and formed inside the coining part (see 22*d* in FIG. 4) is a rectangular shaped recess 22*c* with a constant, unified depth in the horizontal direction at an opening part of the second electrode 22 towards the third electrode 23.

More specifically, the recess 22*c* forms a groove having a constant depth, and the electron beam passing hole 22*b* is located at the center of the groove. In fact, one can more easily fabricate the electron beam passing hole 22*b* by having the electron beam passing hole 22*b* be formed in the recess 22*c* with a relatively thinner thickness than the total thickness of the second electrode 22.

For convenience of explanation, the depth of the recess formed on the second electrode is defined as 'd', and the vertical width (size) of the recess is defined as 'W'.

Figure 5:
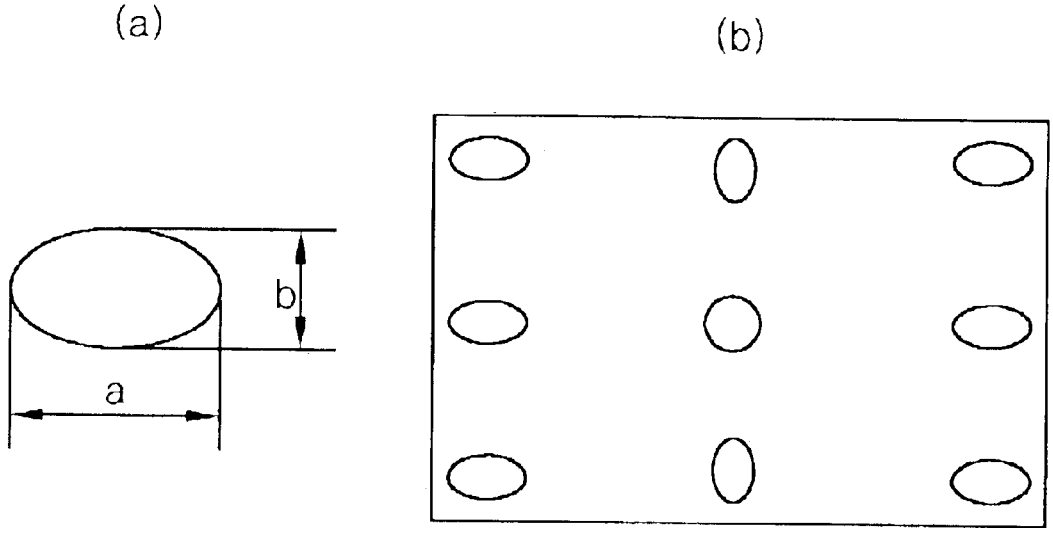
FIG. 5 (Related Art)
FIG. 5 diagrammatically depicts the shape of an electron beam incidented upon a main lens and the shapes of electron beams exhibited on a fluorescent screen.
Figure 6:
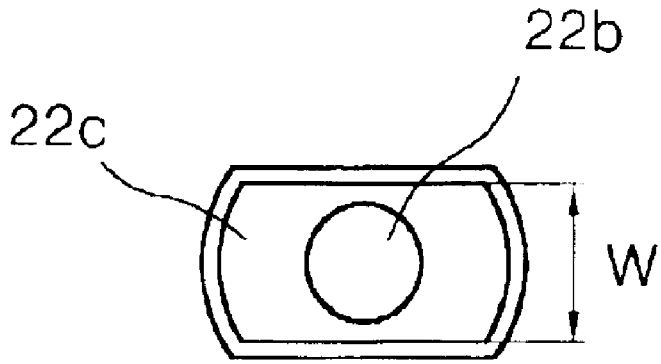
FIG. 6 (Related Art)
FIG. 6 diagrammatically explains the depth of a recess formed on the second electrode and a vertical width (size) of the recess.
Figure 6:
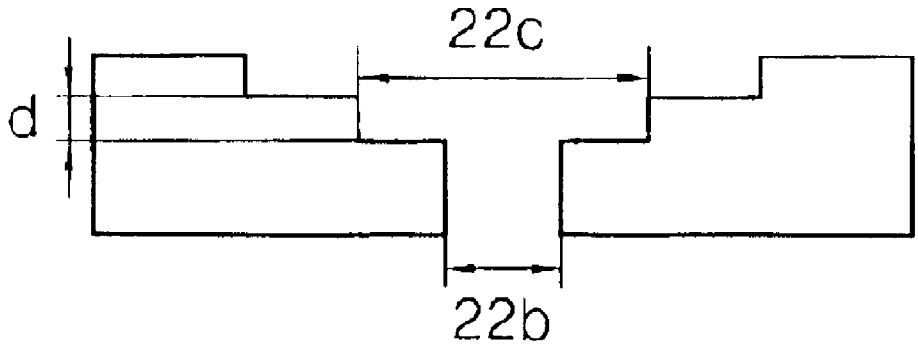
FIG. 6 (Related Art)
Figure 7:
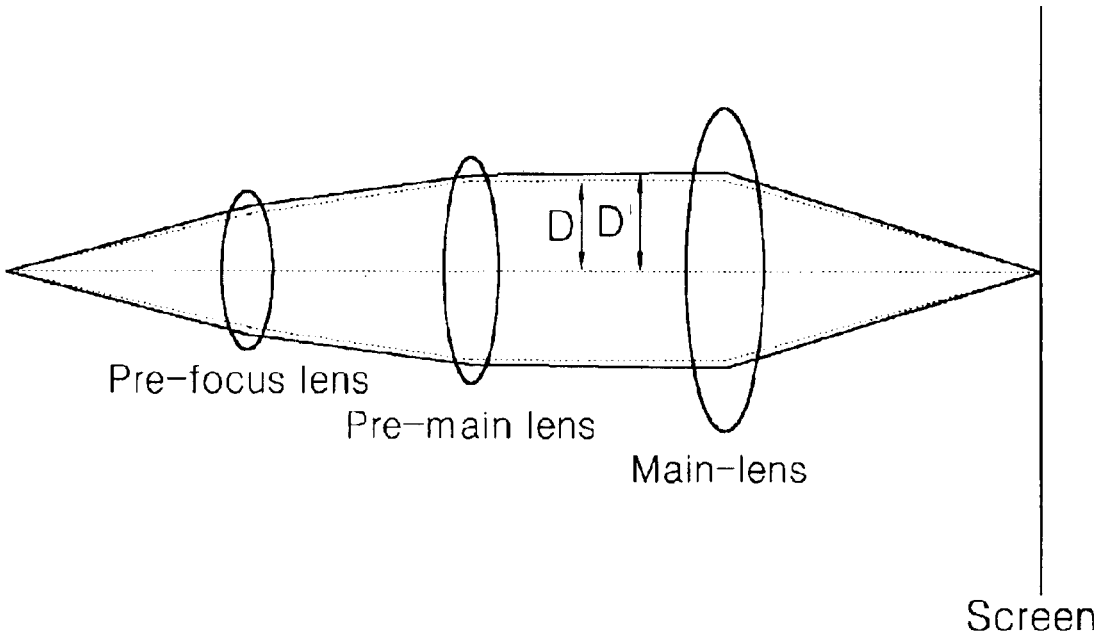
FIG. 7 (Related Art)
FIG. 7 diagrammatically illustrates an enlarged beam diameter responsive to an increase in current capacity.

In general, the depth, d, of the recess and the width in the vertical direction, W, are major factors influencing the spot size. The spot size changes depending on the width, W, and depth, d, of the recess, and the ratio of the length, d, to the diameter, a, of the electron beam incidented on the main lens (b/a) (refer to FIG. 5). Together with these variables, the spot size also changes when a high current has been applied or when a low current has been applied to the electron gun.

Figure 12:
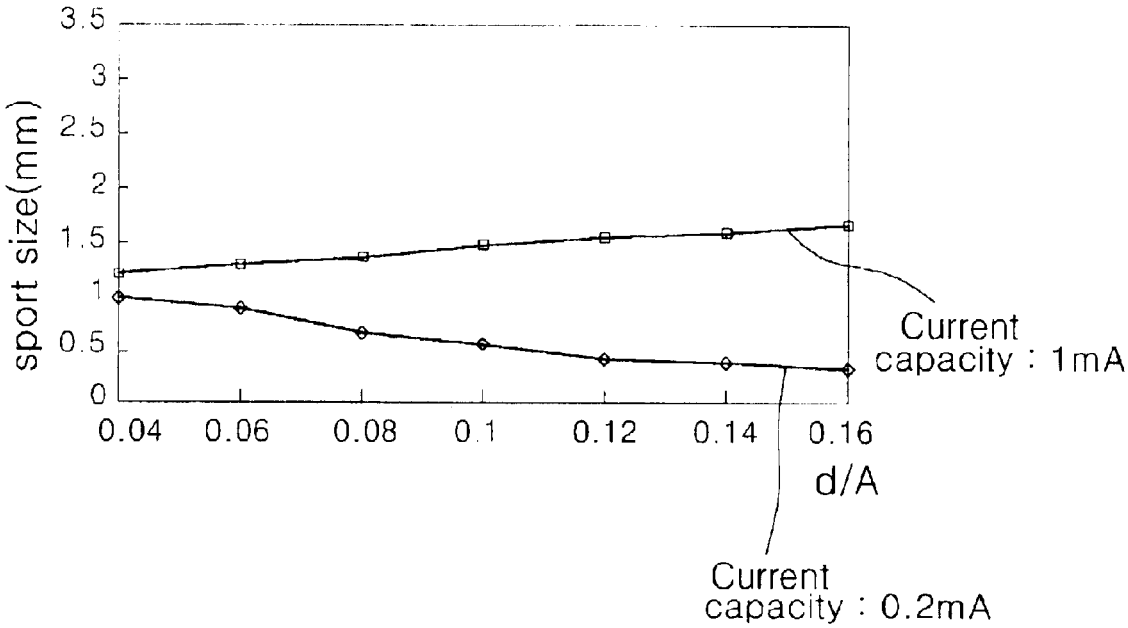
FIG. 12 graphically depicts a relation between a ratio of the depth, d, of a recess formed on the second electrode to the vertical width (size), W, of the recess, i.e. d/W, and the spot size.

FIG. 12 is a graph illustrating the relation between the spot size and the ratio of the depth to width (d/W) of the recess formed on the second electrode.

As manifested in the graph, provided that a low current (e.g. 0.2 mA) is applied to the electron gun, the spot size gets smaller as the ratio of the depth to width (d/W) of the recess increases. Meanwhile, if a high current (e.g. 1 mA) is applied to the electron gun, the spot size gets so big that it might cause some fatal influence on the resolution.

Therefore, to maintain a unified spot size regardless of high currents or low currents, it is necessary to adjust the depth, d, and width in the vertical direction, W, of the recess formed on the second electrode 22 in addition to the diameter, A, and thickness, t, of the electron beam passing hole formed on the fourth electrode 24.

Figure 13:
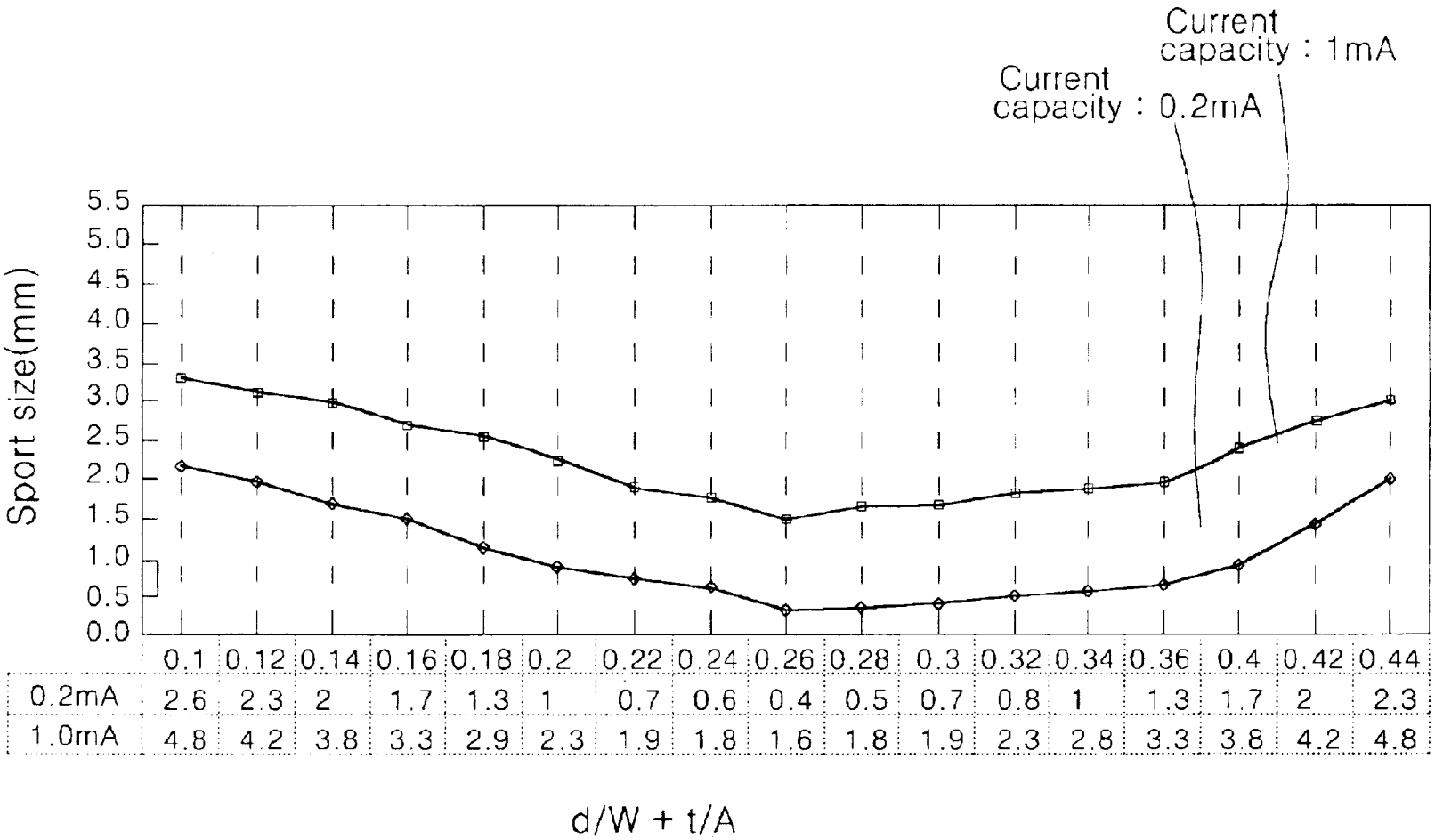
FIG. 13 graphically illustrates how the spot size changes responsive to the depth, d, of the recess formed on the second electrode, the vertical width (size), W, of the recess, the diameter, A, and the thickness, t, of the electron beam passing hole formed on the fourth electrode.

FIG. 13 graphically illustrates how the spot size varies depending on the depth, d, of the recess formed on the second electrode 22, the vertical width (size), W, of the recess, the diameter, A, and the thickness, t, of the electron beam passing hole formed on the fourth electrode 24.

Considering that the primary object is to get a desired resolution no matter what kind of current, high or low, is applied to the electron gun, the vertical width (size), W, and depth, d, of the recess formed on the second electrode, the diameter, A, and thickness, t, of the electron beam formed on the fourth electrode should be properly coordinated to each other. Preferably, the second electrode and the fourth electrode should satisfy a relation of $$0.22 \le \frac{d}{W} + \frac{t}{A} \le 0.38.$$

Provided the above requirement is met, a desired spot size for the low current is not larger than 0.7 mm, and a desired spot size for the high current is not larger than 2.0 mm.

In other words, it became possible to watch moving images with the resolution at a satisfactory level without worrying about sudden changes of the current capacity applied to the electron gun.

Also, people are now able to watch moving images on a computer monitor thanks to a high data transmission rate over Internet. To reproduce the moving images on the computer monitor, however, the current for driving the cathode ray tube connected to the monitor varies from 0.2 mA to 1.0 mA.

If 1 mA of high current is applied to the electron gun, the diameter, D, of the electron beam gets larger than 4 mm, causing the electron beam to collide with the electrode.

Figure 14:
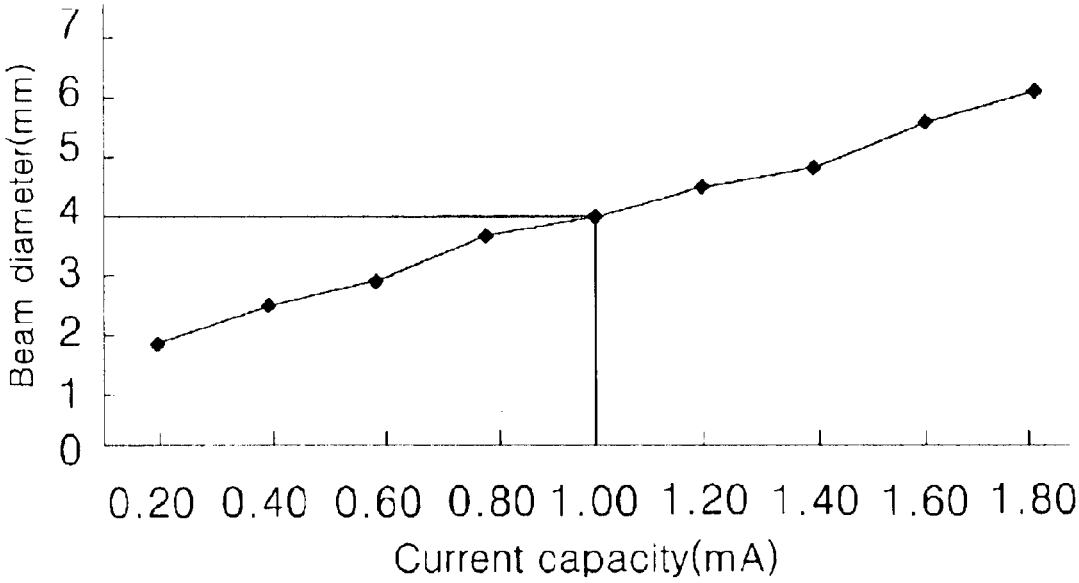
FIG. 14 is a graph explaining a proportional relation between the beam diameter and the current capacity.

FIG. 14 is a graph explaining that the beam diameter gets larger in proportion to the current capacity.

As shown in the graph, when the current capacity applied is greater than 1 mA, the beam diameter is also larger than 4 mm, proving their proportional relation to each other.

Figure 15:
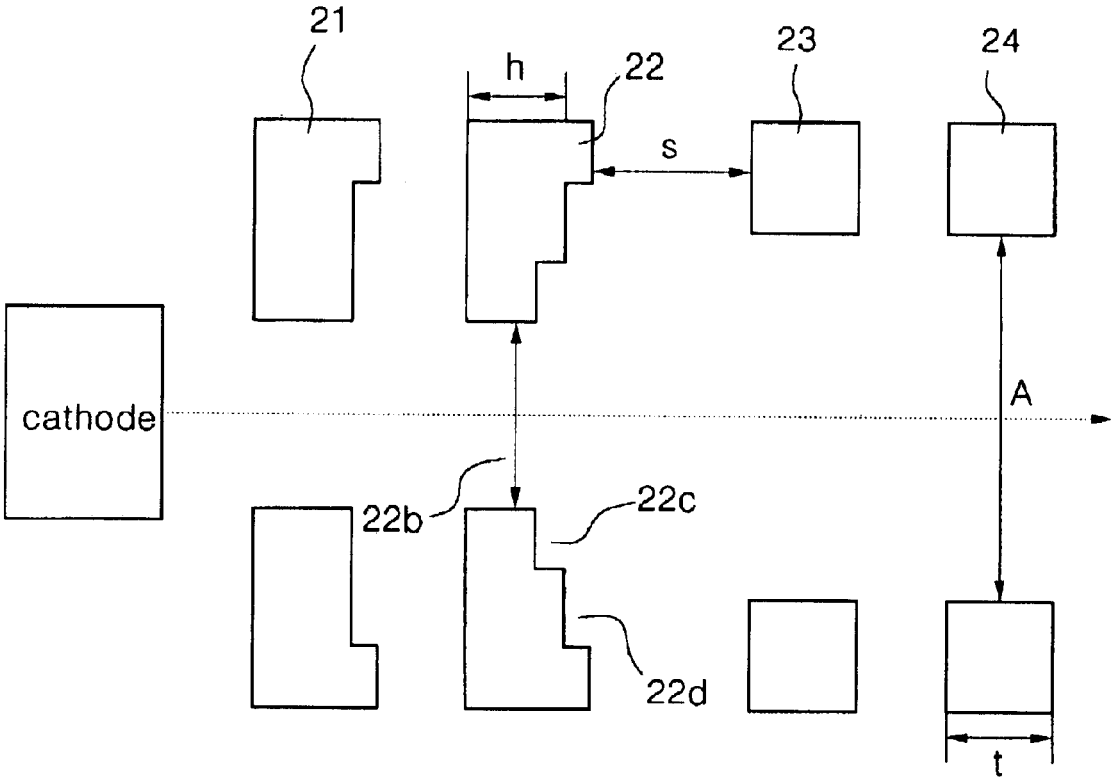
FIG. 15 is an explanatory diagram of the beam diameter dependent on the relation of the first electrode, the second electrode, the third electrode and the fourth electrode for the cathode ray tube of the present invention.

FIG. 15 diagrammatically explains the beam diameter in relation to the first through fourth electrodes 21 through 24 of the cathode ray tube according to the present invention.

Overall, the beam diameter is shortened if the intensity of the pre-focus and pre-main lenses gets stronger. The beam diameter, therefore, can be controlled, conforming to the relation among the first electrode 21, the second electrode 22, the third electrode 23, and the fourth electrode 24.

Preferably, the beam diameter should not be larger than 4 mm to prevent the collision of electron beams against the electrodes.

As illustrated in FIG. 9, FIG. 11 and FIG. 15, coining parts 22*d* are formed on the front surface of the second electrode 22, being spaced out for a predetermined distance from each other. In order to obtain the beam diameter in a preferable range (i.e. not larger than 4 mm), the second electrode 22, the third electrode 23, and the fourth electrode 24 should satisfy a relation of $$0.6 \le \frac{h}{s} + \frac{t}{A} \le 0.8,$$

wherein 'h' is defined as the thickness of the electrodes without adding the depth of the coining part 22*d*; 's' is defined as the space between the second electrode 22 and the third electrode 23; 't' is defined as the thickness of the fourth electrode 24, which is spaced out for a predetermined distance from the third electrode 23; and 'A' is defined as the diameter of an electron beam passing hole 24*b* formed on the fourth electrode 24.

Figure 16:
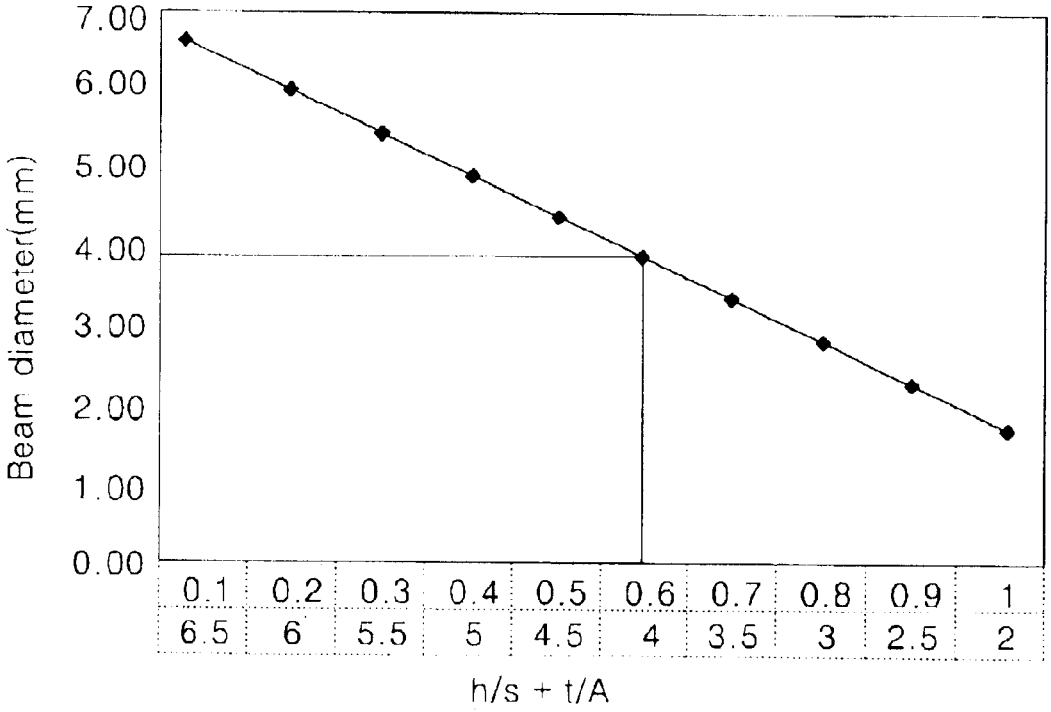
FIG. 16 graphically depicts a relation between the beam diameter and the value of $$\frac{h}{s}+\frac{t}{A};$$

More details on the above are provided with reference to FIGS. 15, 16 and 17.

FIG. 16 graphically depicts a relation between the beam diameter and the value of $$\frac{h}{s} + \frac{t}{A}.$$

The beam diameter gets smaller as the thickness, h, of the second electrode 22 subtracted by the depth of the coining part 22*d* is increased and the space, s, between the second electrode 22 and the third electrode 23 gets narrower.

Moreover, the beam diameter gets smaller as the thickness, t, of the fourth electrode 4 is increased and the diameter, A, of the electron beam passing hole 24*b* formed on the fourth electrode 24 is decreased.

In short, the value of $$\frac{h}{s} + \frac{t}{A}$$

is a key factor of controlling the beam diameter.

Such relation is well defined in the graph of FIG. 16. As demonstrated, the beam diameter gets smaller as the value of $$\frac{h}{s} + \frac{t}{A}$$

increases.

If the value of $$\frac{h}{s} + \frac{t}{A}$$

is smaller than 0.6 given that the size of the electron beam passing hole is 4.0 mm, it is observed that the electron beam collides with the electrode.

As such, the value of $$\frac{h}{s} + \frac{t}{A}$$

should be greater than 0.6.

FIG. 17 is a graph explaining the relation between the spot size and the value of $$\frac{h}{s}+\frac{t}{A}.$$

As shown in the drawing, the spot size decreases to a certain point as the value of $$\frac{h}{s}+\frac{t}{A}$$

increases, and increases again in proportion to the value of $$\frac{h}{s}+\frac{t}{A}.$$

In general, the desired spot size under the low current should not be larger than 0.7 mm to maintain the resolution of the color monitor cathode ray tube.

This means that the value of $$\frac{h}{s}+\frac{t}{A}$$

should be smaller than 0.8 according to the graph shown in FIG. 17.

To meet the two requirements, that is, the electron beam should not collide with the electrode and the resolution of images should be satisfactory, the value of $$\frac{h}{s}+\frac{t}{A}$$

is not smaller than 0.6 and not larger than $$0.8\left(0.6 \le \frac{h}{s}+\frac{t}{A} \le 0.8\right).$$

In conclusion, the cathode ray tube of the present invention gains a desired focus characteristic capable of meeting the above requirements (i.e. preventing the collision of electron beams with electrodes and getting images with a high resolution at the same time), thereby reproducing high quality images over the full screen.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cathode ray tube with an electron gun comprising a cathode for emitting electron beams; and a first electrode, a second electrode, a third electrode, a fourth electrode, a fifth electrode, a sixth electrode and a shield cup, which are arranged in a cited order from the cathode to the direction of a fluorescent screen, where a vertical size, W, of a recess formed on the second electrode, a depth, d, of the recess, a diameter, A, of an electron beam passing hole formed on the fourth electrode, and a thickness, t, of the electron beam passing hole satisfy a relation of $$0.22 \le \frac{d}{W}+\frac{t}{A} \le 0.38.$$

2. The cathode ray tube according to claim 1, wherein a recess in horizontally elongated rectangular shape is formed on the second electrode toward a direction of the third electrode, and electron beam passing holes with a predetermined diameter and thickness are formed on the fourth electrode.

3. The cathode ray tube according to claim 1, an applied voltage to the fourth electrode ranges from 300V to 1000V.

4. The cathode ray tube according to claim 1, an applied voltage to the second electrode ranges from 300V to 1000V.

5. A cathode ray tube with an electron gun comprising a cathode for emitting electron beams; and a first electrode, a second electrode, a third electrode, a fourth electrode, a fifth electrode, a sixth electrode and a shield cup, which are arranged in a cited order from the cathode to the direction of a fluorescent screen, coining parts being formed on a front surface of the second electrode at regular intervals, where a thickness, h, of the electrodes without adding a depth of the coining part, a space, s, between the second electrode and the third electrode, a thickness, t, of the fourth electrode, which is spaced out for a predetermined distance from the third electrode, and a diameter, A, of an electron beam passing hole formed on the fourth electrode satisfy a relation of $$0.6 \le \frac{h}{s}+\frac{t}{A} \le 0.8.$$

6. The cathode ray tube according to claim 5, an applied voltage to the fourth electrode ranges from 300V to 1000V.

7. The cathode ray tube according to claim 5, an applied voltage to the second electrode ranges from 300V to 1000V.

8. The cathode ray tube according to claim 5, an applied voltage to the third electrode ranges from 6000V to 10000V.

9. A cathode ray tube with an electron gun comprising a cathode for emitting electron beams; and a first electrode, a second electrode, a third electrode, a fourth electrode, a fifth electrode, a sixth electrode and a shield cup, which are arranged in a cited order from the cathode to the direction of a fluorescent screen, coining parts and recesses being formed on a front surface of the second electrode at regular intervals, where a thickness, h, of the electrodes without adding a depth of the coining part, a vertical size, W, of the recess, a depth, d, of the recess, a space, s, between the second electrode and the third electrode, a thickness, t, of the fourth electrode, which is spaced out for a predetermined distance from the third electrode, and a diameter, A, of an electron beam passing hole formed on the fourth electrode satisfy relations of $$0.22 \leq \frac{d}{W} + \frac{t}{A} \leq 0.38 \text{ and } 0.6 \leq \frac{h}{s} + \frac{t}{A} \leq 0.8.$$

10. The cathode ray tube according to claim 9, an applied voltage to the fourth electrode ranges from 300V to 1000V.

11. The cathode ray tube according to claim 9, an applied voltage to the second electrode ranges from 300V to 1000V.

12. The cathode ray tube according to claim 9, an applied voltage to the third electrode ranges from 6000V to 10000V.

* * * * *